US007466302B2

(12) United States Patent
Kim et al.

(10) Patent No.: US 7,466,302 B2
(45) Date of Patent: Dec. 16, 2008

(54) DISPLAY APPARATUS AND METHOD OF DRIVING THE SAME

(75) Inventors: Jin-Hong Kim, Seoul (KR); Cheol-Woo Park, Suwon-si (KR); Chong-Chul Chai, Seoul (KR); Kyoung-Ju Shin, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 832 days.

(21) Appl. No.: 10/949,068

(22) Filed: Sep. 24, 2004

(65) Prior Publication Data

US 2005/0134548 A1 Jun. 23, 2005

(30) Foreign Application Priority Data

Dec. 19, 2003 (KR) ..... 10-2003-0093836

(51) Int. Cl.
*G09G 3/36* (2006.01)

(52) U.S. Cl. ..... 345/102; 345/87; 345/89; 345/207; 345/211; 345/212; 315/154; 315/156; 315/307

(58) Field of Classification Search ..... 345/102, 345/211–214, 207, 87–100
See application file for complete search history.

(56) References Cited

U.S. PATENT DOCUMENTS

| | | | | |
|---|---|---|---|---|
| 5,786,801 | A * | 7/1998 | Ichise | 345/102 |
| 5,933,089 | A * | 8/1999 | Katada | 340/7.55 |
| 6,888,528 | B2 * | 5/2005 | Rai et al. | 345/102 |
| 2003/0137485 | A1 * | 7/2003 | Wei et al. | 345/102 |
| 2005/0179682 | A1 * | 8/2005 | Shin et al. | 345/207 |

* cited by examiner

*Primary Examiner*—Richard Hjerpe
*Assistant Examiner*—Jennifer T Nguyen
(74) *Attorney, Agent, or Firm*—F. Chau & Assoc., LLC

(57) ABSTRACT

A light generating part generates a first light based on a first control signal. A first driving part outputs a panel driving signal. A display panel receives the first light or a second light that is provided from an exterior to display an image based on the panel driving signal. A sensing part outputs a sensing signal based on the second light. A second driving part compares a reference voltage range with the sensing signal to output the first control signal. The reference voltage range is determined by a first reference voltage and a second reference voltage. Therefore, the light generating part is turned on/off based on the second light to decrease the power consumption of the light generating part, and an operation of the light generating part is stabilized.

30 Claims, 8 Drawing Sheets

DISPLAY APPARATUS AND METHOD OF DRIVING THE SAME

CROSS-REFERENCE OF RELATED APPLICATIONS

The present application claims priority from Korean Patent Application No. 2003-93836, filed on Dec. 19, 2003, the disclosure of which is hereby incorporated herein by reference in its entirety.

BACKGROUND OF THE INVENTION

1. Field of the Invention

The present invention relates to a display apparatus and a method of driving the display apparatus. More particularly, the present invention relates to a display apparatus capable of controlling an operation of a light generating part and reducing power consumption thereof and a method of driving the display apparatus.

2. Description of the Related Art

A display apparatus, generally, includes a display panel displaying an image using a light. The light may be an externally provided light such as a sunlight, an illumination light, etc., or an internally provided light generated from a backlight, a front-light, etc.

The display apparatus displays the image using the externally provided light and the internally provided light. The display apparatus displays the image using the externally provided light in a bright place, and displays the image using the internally provided light in a dark place.

A power consumption of the backlight assembly may be about 70% of the power consumption of the display apparatus. A backlight assembly having low power consumption is in demand for a portable display device such as a cellular phone, a notebook computer, personal digital assistants (PDA), etc.

When the power consumption of the backlight assembly decreases, the amount of the light generated from the backlight assembly also decreases, thereby decreasing luminance of the display apparatus.

BRIEF SUMMARY OF THE INVENTION

The present invention provides a display apparatus capable of controlling an operation of a light generating part and reducing power consumption thereof.

The present invention also provides a method of driving the above-mentioned display apparatus.

A display apparatus in accordance with one exemplary embodiment of the present invention includes a light generating part, a first driving part, a display panel, a sensing part and a second driving part. The light generating part generates a first light based on a first control signal. The first driving part outputs a panel driving signal. The display panel is disposed on the light generating part to receive the first light that is generated from the light generating part or a second light that is provided from an exterior to display an image based on the panel driving signal. The sensing part is disposed on the display panel to output a sensing signal based on the second light that is provided from an exterior to the display panel. The second driving part is disposed between the sensing part and the light generating part to compare a reference voltage range with the sensing signal to output the first control signal. The voltage range is determined based on a first reference voltage and a second reference voltage higher than the first reference voltage.

A method of manufacturing in accordance with one exemplary embodiment of the present invention is provided. A first light is generated based on a control signal. A panel driving signal is outputted. The first light or a second light is received to display an image based on the panel driving signal. The second light is provided from an exterior to display an image. A sensing signal is outputted based on the second light. The sensing signal is compared with a first reference level and a second reference level higher than the first reference level to output the control signal. The first and second reference levels determine a voltage reference range.

Therefore, the light generating part is turned on/off based on the amount of the second light to decrease the power consumption of the light generating part. In addition, number of the turning on/off is decreased to stabilize the operation of the light generating part.

BRIEF DESCRIPTION OF THE DRAWINGS

The above and other advantages of the present invention will become more apparent by describing in detail exemplary embodiments thereof with reference to the accompanying drawings, in which.

DESCRIPTION OF THE EMBODIMENTS

Hereinafter, the embodiments of the present invention will be described in detail with reference to the accompanying drawings.

Figure 1:
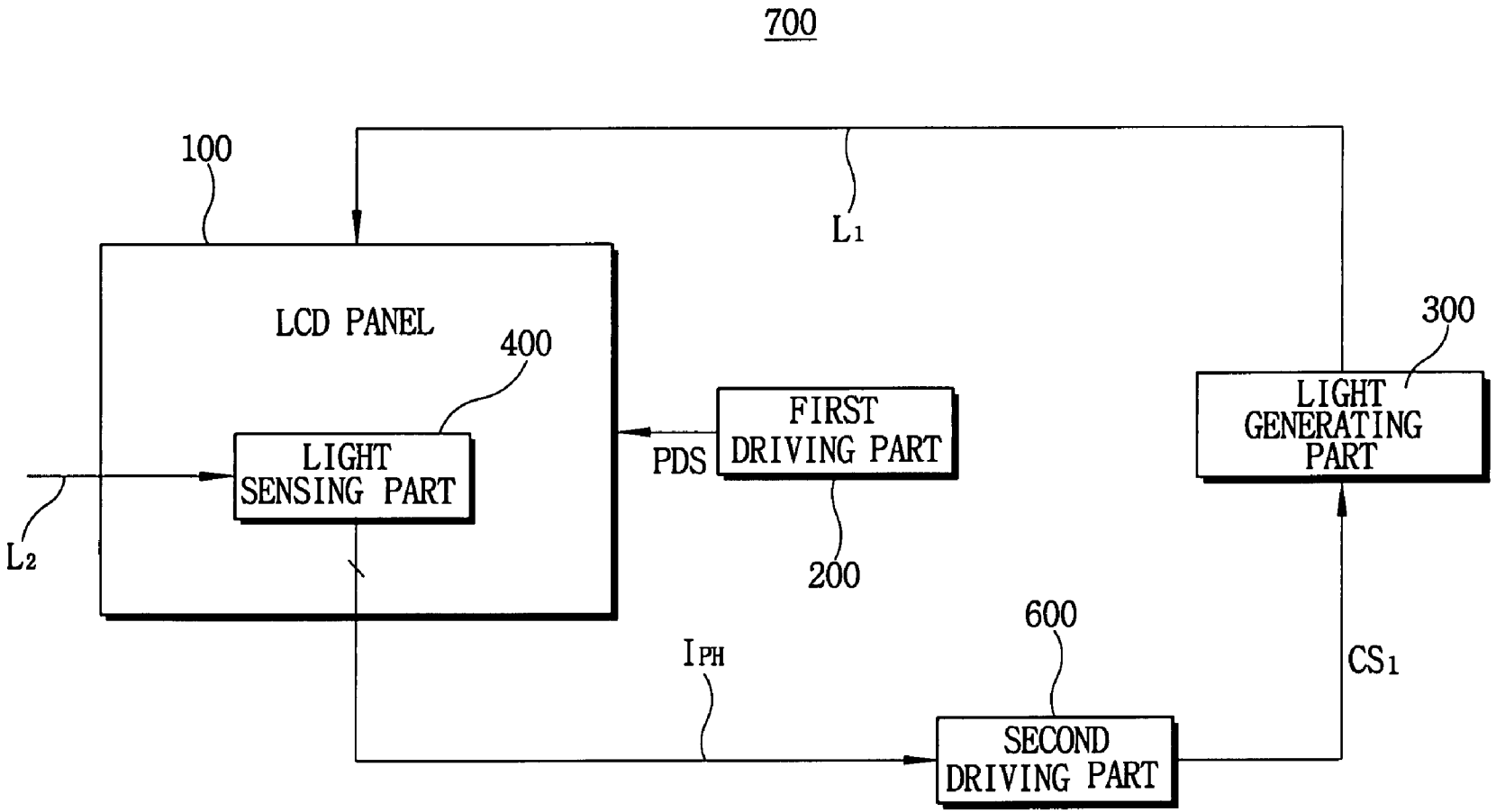
FIG. 1 is a block diagram showing a display apparatus according to an exemplary embodiment of the present invention.

FIG. 1 is a block diagram showing a display apparatus according to an exemplary embodiment of the present invention.

Referring to FIG. 1, the liquid crystal display (LCD) apparatus 700 includes an LCD panel 100 displaying an image, a first driving part 200 outputting a panel driving signal PDS that drives the LCD panel 100, a light generating part 300 supplying the LCD panel 100 with an internally provided light $L_1$ and a second driving part 600 driving the light generating part 300.

The LCD panel 100 includes a light sensing part 400 outputting a photo current $I_{ph}$ based on an amount of an externally provided light $L_2$ that is supplied from an exterior to the LCD panel 100. The second driving part 600 outputs a first control signal $CS_1$ driving the light generating part 300 based on the photo current $I_{ph}$ outputted from the light sensing part 400.

When the externally provided light $L_2$ is insufficient to display the image, the light sensing part 400 outputs the photo current $I_{ph}$ based on the insufficient externally provided light $L_2$ so that the second driving part 600 outputs the first control signal corresponding to the insufficient externally provided light $L_2$. Therefore, the light generating part 300 generates the internally provided light $L_1$ based on the first control signal $CS_1$ corresponding to the insufficient externally provided light $L_2$ so that the LCD panel 100 displays an image using the internally and externally provided lights $L_1$ and $L_2$.

When the externally provided light $L_2$ is sufficient to display the image, the light sensing part 400 outputs the photo current $I_{ph}$ based on the sufficient externally provided light $L_2$ so that the second driving part 600 outputs the first control signal corresponding to the sufficient externally provided light $L_2$. Therefore, the light generating part 300 does not generate the internally provided light $L_1$ based on the first control signal $CS_1$ corresponding to the sufficient externally provided light $L_2$ so that the LCD panel 100 displays the image using the externally provided light $L_2$.

The LCD apparatus 700 turns on/off the light generating part 300 based on a variation of the amount of the externally provided light $L_2$. Therefore, a power consumption of the LCD apparatus 700 is decreased. In addition, the LCD apparatus 700 may display the image of an improved display quality in a dark place although the power consumption of the LCD apparatus 700 is decreased.

Figure 2:
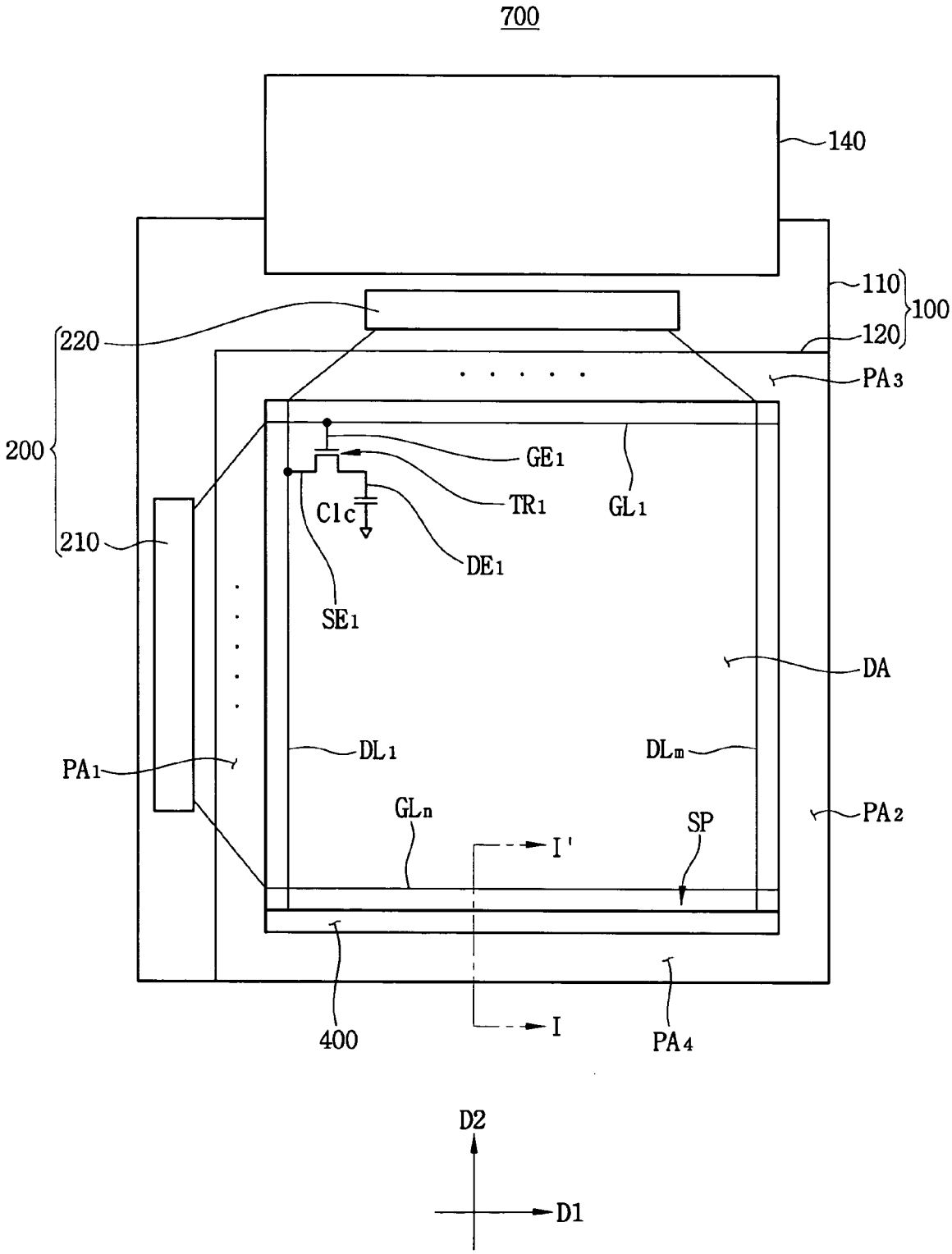
FIG. 2 is a plan view showing a liquid crystal display (LCD) apparatus according to an exemplary embodiment of the present invention.
Figure 3:
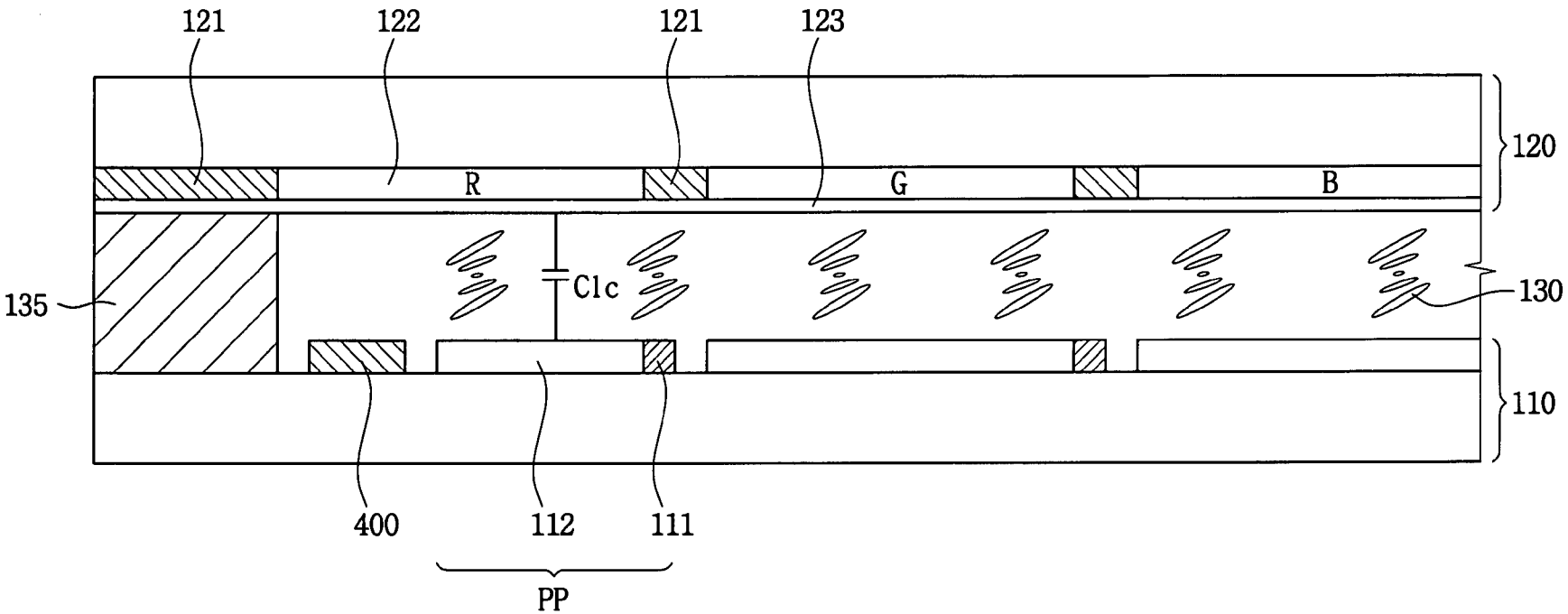
FIG. 3 is a cross-sectional view taken along the line I-I' shown in FIG. 2.

FIG. 2 is a plan view showing a liquid crystal display (LCD) apparatus according to an exemplary embodiment of the present invention, and FIG. 3 is a cross-sectional view taken along the line I-I' shown in FIG. 2.

Referring to FIGS. 2 and 3, the LCD panel 100 includes a lower substrate 110, an upper substrate 120 corresponding to the lower substrate 110, a liquid crystal layer 130 interposed between the lower and upper substrates 110 and 120, and a sealant 135.

The LCD panel 100 includes a display area DA where the image is displayed and first to fourth peripheral areas $PA_1$, $PA_2$, $PA_3$ and $PA_4$ are disposed at a position adjacent to the display area DA.

The upper substrate 120 includes a blocking layer 121, a color filter 122 and a common electrode 123.

The color filter 122 includes a red color filter unit corresponding to a red color, a green color filter unit corresponding to a green color and a blue color filter unit corresponding to a blue color. The blocking layer 121 is disposed between the color filter units in the display area DA to improve the display quality of the LCD apparatus 700. In addition, the blocking layer 121 is also disposed in a position corresponding to the first to fourth peripheral areas $PA_1$, $PA_2$, $PA_3$ and $PA_4$. The common electrode 123 is uniformly formed in thickness on the blocking layer 121 and the color filter 122.

A plurality of pixel portions PP is arranged in a matrix shape on the lower substrate 110 corresponding to the display area DA. The pixel portions PP are defined by a plurality of gate lines $GL_1, GL_2, \ldots GL_n$ extended in a first direction $D_1$ and a plurality of data lines $DL_1, DL_2, \ldots DL_n$ extended in a second direction $D_2$.

Each of the pixel portions PP includes a pixel thin film transistor $TR_1$ and a pixel electrode PE. The pixel thin film transistor $TR_1$ includes a first gate electrode $GE_1$ electrically connected to one of the gate lines, a first source electrode $SE_1$ electrically connected to one of the data lines, and a first drain electrode DE1 electrically connected to the pixel electrode PE. The pixel electrode PE corresponds to the common electrode 123, and the liquid crystal layer 130 is disposed between the pixel electrode PE and the common electrode 123 to form a liquid crystal capacitor Clc.

The first peripheral area $PA_1$ is disposed at a position adjacent to first end portions of the gate lines $GL_1, GL_2, \ldots GL_n$, and the second peripheral area $PA_2$ is disposed at a position adjacent to the second end portions of the gate lines $GL_1, GL_2, \ldots GL_n$ corresponding to the first end portions. The third peripheral area $PA_3$ is also disposed at a position adjacent to the third end portions of the data lines $DL_1, DL_2, \ldots DL_m$, and the fourth peripheral area $PA_4$ is disposed at a position adjacent to the fourth end portions of the data lines $DL_1, DL_2, \ldots DL_m$ corresponding to the third end portions.

The first driving part 200 driving the LCD panel 100 includes a gate driving integrated circuit 210 disposed in the first peripheral area $PA_1$ and a data driving integrated circuit 220 disposed in the third peripheral area $PA_3$.

The gate driving integrated circuit 210 is electrically connected to the first end portions of the gate lines $GL_1, GL_2, \ldots GL_n$ in the first peripheral area $PA_1$ to successively output gate signals to the gate lines $GL_1, GL_2, \ldots GL_n$. Alternatively, the gate driving integrated circuit 210 may include amorphous silicon so that the gate driving integrated circuit 210 is formed in the first peripheral area $PA_1$ of the lower substrate 110. Alternatively, the gate driving integrated circuit 210 may be directly formed on the lower substrate 110. The gate driving integrated circuit 210 may also be formed in one of the first to fourth peripheral areas $PA_1$, $PA_2$, $PA_3$ and $PA_4$. The gate driving integrated circuit 210 may also be formed from a same layer as the thin film transistors. When the gate driving integrated circuit 210 is formed in one of the first to fourth peripheral areas $PA_1$, $PA_2$, $PA_3$ and $PA_4$, a center of the display area DA may be disposed at a center of the LCD panel 100. The data driving integrated circuit 220 is electrically connected to the third end portions of the data lines $DL_1, DL_2, \ldots DL_m$ in the third peripheral region $PA_3$ to output data signals to the data lines $DL_1, DL_2, \ldots DL_m$. Alternatively, the gate driving integrated circuit 210 and the data driving integrated circuit 220 may form a one chip.

The light sensing part 400 is disposed in a side portion SP of the display area DA adjacent to the fourth peripheral area $PA_4$. The light sensing part 400 outputs the photo current $I_{ph}$ based on the amount of the externally provided light $L_2$ that is provided from an exterior to the LCD panel 100. The photo current $I_{ph}$ varies in proportion to the amount of the externally provided light $L_2$. That is, the photo current $I_{ph}$ increases when the amount of the externally provided light $L_2$ increases. The photo current $I_{ph}$ decreases when the amount of the externally provided light $L_2$ decreases. Alternatively, the sensing part 400 may include amorphous silicon. The light sensing part 400 may be directly formed on the lower substrate 110, and the light sensing part 400 may be formed from the same layer as the thin film transistors, the gate lines, the data lines, etc. so that a manufacturing process of the LCD panel 100 may be simplified.

The data driving integrated circuit 220 is electrically connected to the third end portions of the data lines $DL_1, DL_2, \ldots DL_m$. The fourth end portions of the data lines $DL_1, DL_2, \ldots DL_m$ are disposed in the display area DA so that the fourth end portions of the data lines $DL_1, DL_2, \ldots DL_m$ are not disposed in the fourth peripheral area $PA_4$. Therefore, the light sensing part 400 may not overlapped with the data lines $DL_1, DL_2, \ldots DL_m$ though the light sensing part 400 is disposed in the side portion SP of the display area DA. When the light sensing part 400 is not overlapped with the data lines $DL_1, DL_2, \ldots DL_m$, the gate or data signals that are applied to the display area DA may not be distorted.

A flexible circuit board 140 is disposed in the third peripheral area $PA_3$. The flexible circuit board 140 receives signals from an exterior to the LCD panel to apply the gate driving integrated circuit 210, the data driving integrated circuit 220 and the light sensing part 400 with the signals.

Figure 4:
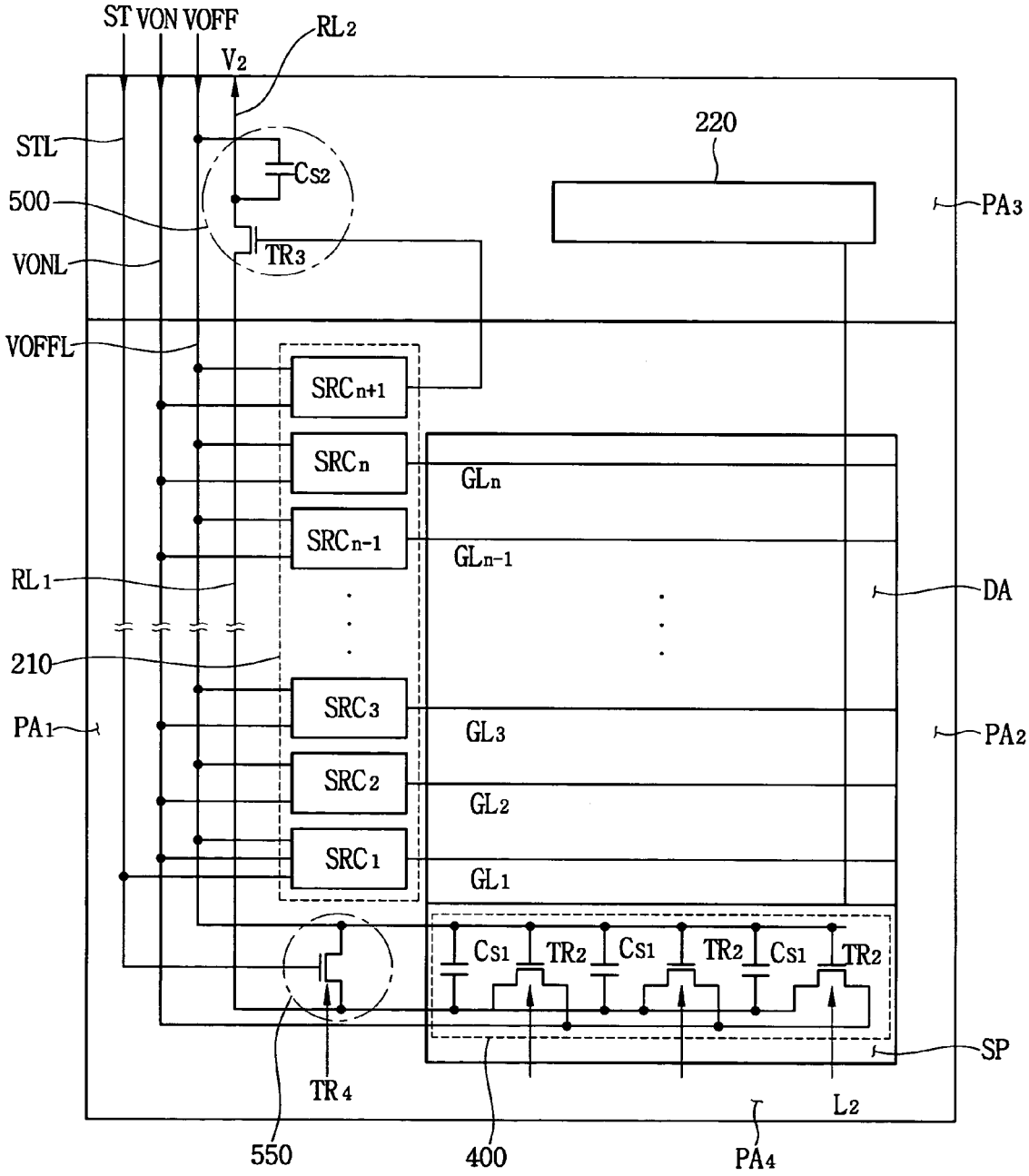
FIG. 4 is a circuit diagram showing an LCD apparatus according to an exemplary embodiment of the present invention.
Figure 5:
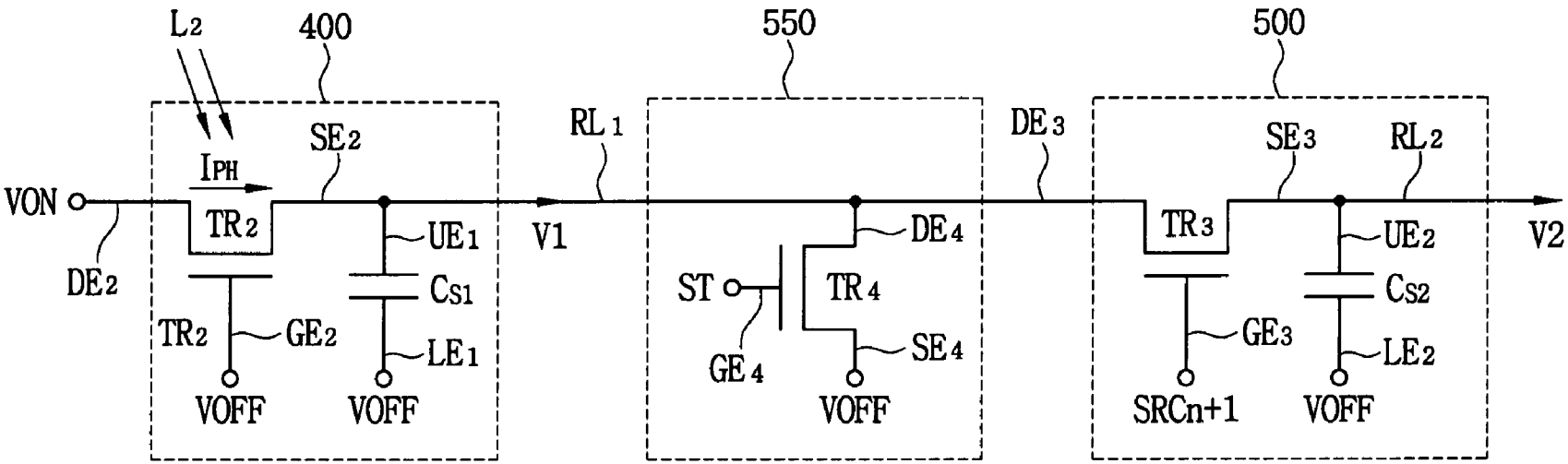
FIG. 5 is a circuit diagram showing a light sensing part according to an exemplary embodiment of the present invention.

FIG. 4 is a circuit diagram showing an LCD apparatus according to an exemplary embodiment of the present invention, and FIG. 5 is a circuit diagram showing a light sensing part according to an exemplary embodiment of the present invention.

Referring to FIG. 4, the light sensing part 400 is disposed in the side portion SP of the display area DA. The gate driving integrated circuits 210 and data driving integrated circuit 220 are disposed in the first and third peripheral areas $PA_1$ and $PA_3$, respectively. The first and third peripheral areas $PA_1$ and $PA_3$ are disposed at a position adjacent to the display area DA.

The gate driving integrated circuit 210 includes a shift resistor having a plurality of stages $SRC_1, SRC_2, \ldots, SRC_{n+1}$. A plurality of gate lines $GL_1, GL_2, \ldots GL_n$ is electrically connected to the stages $SRC_1, SRC_2, \ldots, SRC_n$ so that the stages $SRC_1, SRC_2, \ldots, SRC_n$ apply the gate signals to the gate lines $GL_1, GL_2, \ldots GL_n$, respectively.

A last stage $SRC_{n+1}$ of the stages $SRC_1, SRC_2, \ldots SRC_{n+1}$ is a dummy stage that drives an n-th stage $SRC_n$.

A first driving voltage line VONL and a second driving voltage line VOFFL are extended in the first direction $D_1$, and are disposed in the first peripheral area $PA_1$ adjacent to the gate driving integrated circuit 210. A start signal ST is applied to the first stage $SRC_1$ through the start signal line STL. The start signal line STL is disposed at a position adjacent to the first driving voltage line VONL.

Referring to FIGS. 4 and 5, the light sensing part 400 includes a plurality of sensing thin film transistors $TR_2$ and a plurality of first storage capacitors $C_{s1}$.

Each of the sensing thin film transistors $TR_2$ includes a second gate electrode $GE_2$ electrically connected to the second driving voltage line VOFFL, a second drain electrode $DE_2$ electrically connected to the first driving voltage line VONL and a second source electrode $SE_2$ electrically connected to a first read-out line $RL_1$. Each of the first storage capacitors $C_{s1}$ includes a first electrode $LE_1$ electrically connected to the second driving voltage line VOFFL and a second electrode $UE_1$ electrically connected to the first read-out line $RL_1$.

A read-out part 500 is disposed in the third peripheral area $PA_3$. The read-out part 500 includes a read-out thin film transistor $TR_3$ and a second storage capacitor $C_{s2}$. The read-out thin film transistor $TR_3$ includes a third gate electrode $GE_3$ electrically connected to an output terminal of the last stage $SRC_{n+1}$, a third drain electrode $DE_3$ electrically connected to the first read-out line $RL_1$ and a third source electrode $SE_3$ electrically connected to the second read-out line $RL_2$. The second storage capacitor $C_{s2}$ includes a third electrode $LE_2$ electrically connected to the second driving voltage line VOFFL and a fourth electrode $UE_2$ electrically connected to the second read-out line $RL_2$.

A reset part 550 is disposed in the first peripheral region $PA_1$. The reset part 550 may initialize the sensing part 400 at every predetermined interval. A reset thin film transistor $TR_4$ of the reset part 550 includes a fourth gate electrode $GE_4$ electrically connected to the start signal line STL, a fourth drain electrode $DE_4$ electrically connected to the first read-out line $RL_1$ and a fourth source electrode $SE_4$ electrically connected to the second driving voltage line VOFFL.

Figure 6:
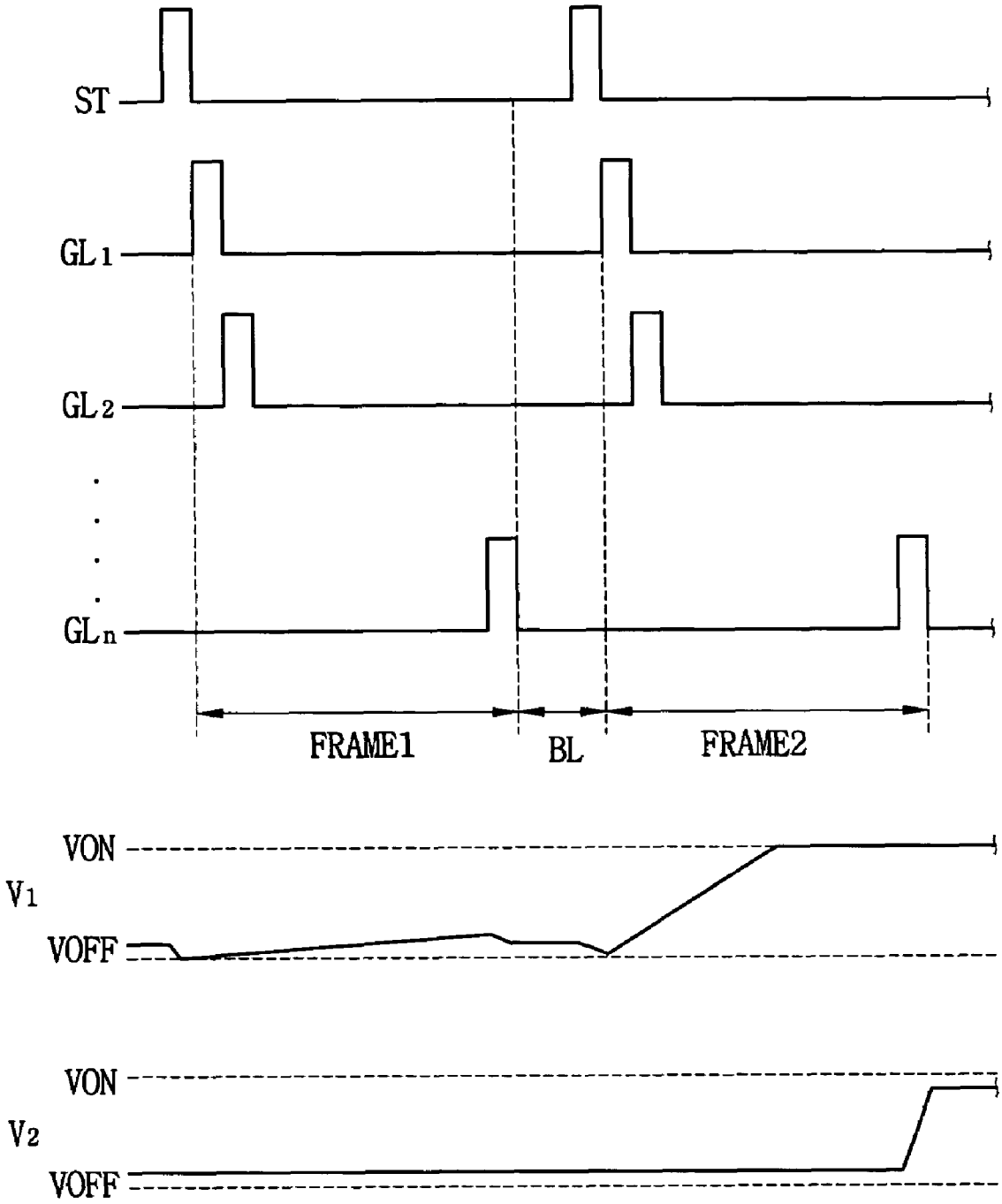
FIG. 6 is a timing diagram showing an output signal of a gate driving integrated circuit (IC) and a light sensing part according to an exemplary embodiment of the present invention.

FIG. 6 is a timing diagram showing an output signal of a gate driving integrated circuit (IC) and a light sensing part according to an exemplary embodiment of the present invention.

Referring to FIG. 6, when the start signal ST is applied to the first stage $SRC_1$ during a first frame, the first stage $SRC_1$ applies a first gate signal to the first gate line $GL_1$.

Subsequently, the second stage $SRC_2$ outputs a second gate signal to the second gate line $GL_2$ based on the first gate signal outputted from the first stage $SRC_1$. The above described processes are repeated so that the gate signals are applied to the gate lines $GL_1, GL_2, \ldots GL_n$, respectively, during the first frame.

The start signal ST is then applied to the first stage $SRC_1$ to start a second frame. The above described processes are repeated so that the gate signals are applied to the gate lines $GL_1, GL_2, \ldots GL_n$, respectively, during the second frame.

A blank period BL is interposed between the first and second frames. The gate signals applied to the gate lines $GL_1, GL_2, \ldots GL_n$, are discharged during the blank period BL so as to initialize the gate lines $GL_1, GL_2, \ldots GL_n$.

The sensing thin film transistor $TR_2$ outputs the photo current $I_{ph}$ to the second source electrode $SE_2$ based on the externally provided light $L_2$. The first storage capacitor $C_{s1}$ receives the photo current $I_{ph}$ that is outputted from the sensing thin film transistor $TR_2$.

When the amount of the externally provided light $L_2$ decreases, the photo current $I_{ph}$ outputted from the sensing thin film transistor $TR_2$ also decreases so that a first voltage $V_1$ charged in the first storage capacitor $C_{s1}$ decreases based on the decreased photo current $I_{ph}$. Therefore, the first voltage $V_1$ is slightly higher than the second driving voltage VOFF during the first frame.

The read-out transistor $TR_3$ is then turned on based on the output signal outputted from the last stage $SRC_{n+1}$. The read-out thin film transistor $TR_3$ reads the first voltage $V_1$ stored in the first storage capacitor $C_{s1}$ so that the second storage capacitor $C_{s2}$ receives a second voltage $V_2$ based on the first voltage $V_1$.

The first voltage $V_1$ stored in the first storage capacitor $C_{s1}$ is discharged during the blank period BL to form the second driving voltage VOFF.

When the amount of the externally provided light $L_2$ increases, the photo current $I_{ph}$ outputted from the sensing thin film transistor $TR_2$ increases. Therefore, the first voltage $V_1$ charged in the first storage capacitor $C_{s1}$ based on the increased photo current $I_{ph}$ also increases to the first driving voltage VON.

The read-out thin film transistor $TR_3$ is then turned on based on the output signal outputted from the last stage $SRC_{n+1}$. Therefore, the read-out thin film transistor $TR_3$ reads the first voltage $V_1$ stored in the first storage capacitor $C_{s1}$ so that the second storage capacitor $C_{s2}$ receives the second voltage $V_2$ based on the first voltage $V_1$.

Figure 7:
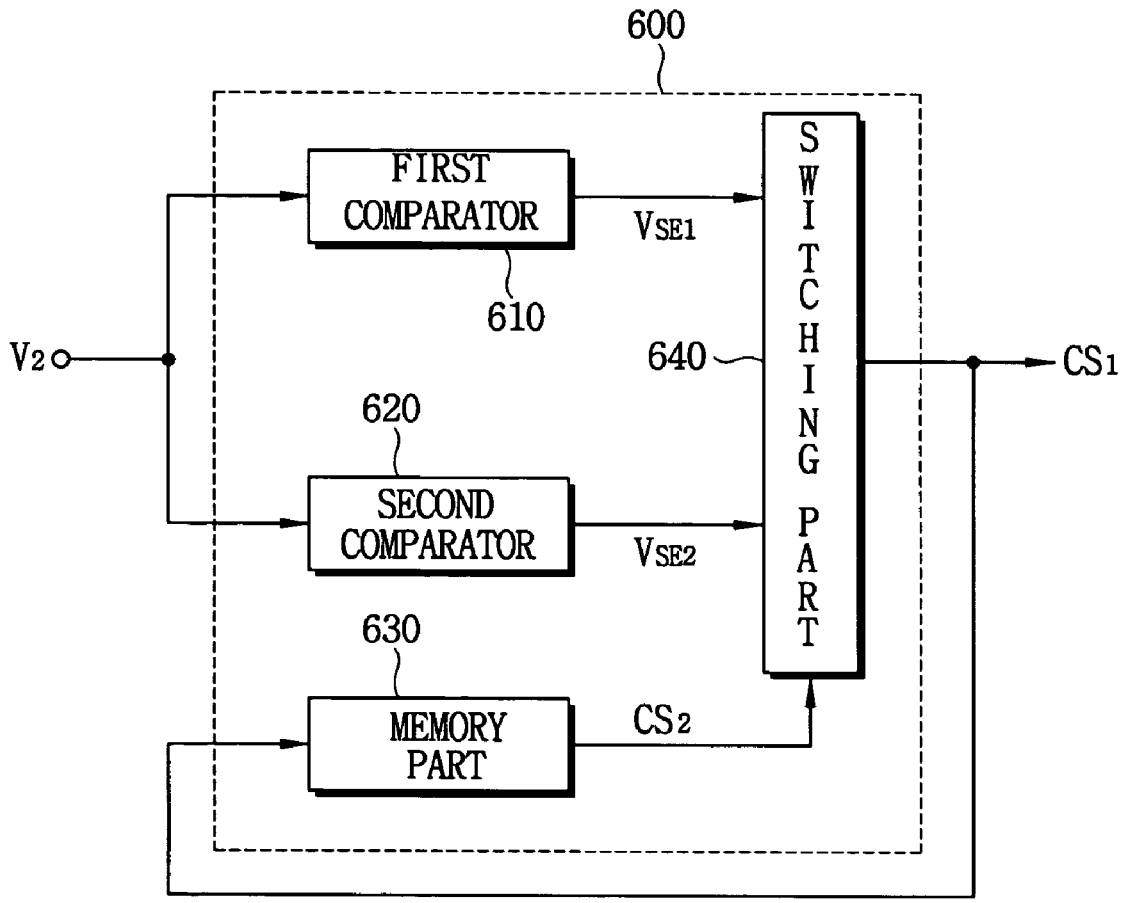
FIG. 7 is a block diagram showing a second driving part according to an exemplary embodiment of the present invention.
Figure 8:
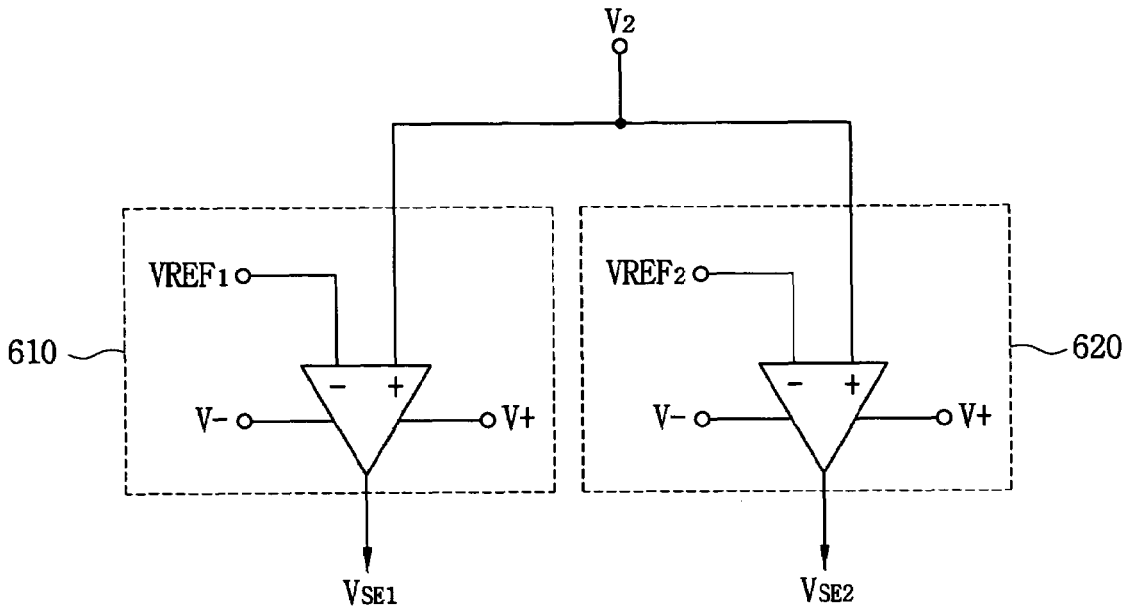
FIG. 8 is a circuit diagram showing a first comparator and a second comparator.

FIG. 7 is a block diagram showing a second driving part according to an exemplary embodiment of the present invention, and FIG. 8 is a circuit diagram showing a first comparator and a second comparator.

Referring to FIGS. 7 and 8, the second driving part 600 includes a first comparator 610, a second comparator 620, a memory part 630 and a switching part 640.

The first comparator 610 receives the second voltage $V_2$ outputted from the read-out part 500, and includes a first operational amplifier OP-AMP that compares the second voltage $V_2$ with a first reference voltage $VREF_1$ to output a first state voltage $V_{SE1}$. The first reference voltage $VREF_1$ is a minimum voltage of a reference voltage range. When the second voltage $V_2$ is higher than the first reference voltage $VREF_1$, the first state voltage $V_{SE1}$ has a first voltage level V+. When the second voltage $V_2$ is lower than the first reference voltage $VREF_1$, the first state voltage $V_{SE1}$ has a second voltage level V−.

The second comparator 620 receives the second voltage $V_2$ outputted from the read-out part 500, and includes a second operational amplifier OP-AMP that compares the second voltage $V_2$ with a second reference voltage $VREF_2$ to output a second state voltage $V_{SE2}$. The second reference voltage $VREF_2$ is a maximum voltage in the reference voltage range. When the second voltage $V_2$ is higher than the second reference voltage $VREF_2$, the second state voltage $V_{SE2}$ has the first voltage level V+. When the second voltage $V_2$ is lower than the second reference voltage $VREF_2$, the second voltage $V_{SE2}$ has the second voltage level V−.

The first and second reference voltages $VREF_1$ and $VREF_2$ may be adjusted to prevent a noise signal generated from the externally provided light $L_2$. Alternatively, the first and second reference voltages $VREF_1$ and $VREF_2$ may be also adjusted based on a sensitivity of the light sensing part 400.

A memory part 630 outputs a second control signal $CS_2$ that is outputted from the switching part 640 and corresponds to a previous frame. The memory part 630 stores a first control signal $CS_1$ that is outputted from the switching part 640 and corresponds to a present frame. The second control signal $CS_2$ is the on/off signal that turns on/off the light generating part 300, and corresponds to a state of the light generating part 300.

The switching part 640 receives the first state voltage $V_{SE1}$ outputted from the first comparator 610, the second state voltage $V_{SE2}$ outputted from the second comparator 620 and the second control signal $CS_2$ outputted from the memory part 630.

Table 1 represents digitalized signals including input and output signals of the switching part 640.

TABLE 1

| CS2 | D-low | D-high | CS1 |
|---|---|---|---|
| 0 | 0 | 0 | 0 |
| 0 | 0 | 1 | 0 |
| 0 | 1 | 0 | X |
| 0 | 1 | 1 | 1 |
| 1 | 0 | 0 | 0 |
| 1 | 0 | 1 | 1 |
| 1 | 1 | 0 | X |
| 1 | 1 | 1 | 1 |

Referring to Table 1, when the first and second control signals $CS_1$ and $CS_2$ are in a low state (0), the light generating part 300 is turned off. When the first and second control signals $CS_1$ and $CS_2$ are in a high state (1), the light generating part 300 is turned on.

A first state signal (D-low) is digitalized signal of the first state voltage $V_{SE1}$. That is, when the first state signal (D-low) is in the low state (0), the first state voltage $V_{SE1}$ has the first voltage level (V+). In addition, when the first state signal (D-low) is in the high state (1), the first state voltage $V_{SE1}$ has the second voltage level (V−).

A second state signal (D-high) is the digitalized signal of the second state voltage $V_{SE2}$. That is, when the second state signal (D-high) is in the low state (0), the second state voltage $V_{SE2}$ has the first voltage level (V+). In addition, when the second state signal (D-high) is in the high state (1), the second state voltage $V_{SE2}$ has the second voltage level (V−).

Referring again to the Table 1, when the second control signal $CS_2$ is in the low state (0), that is the light generating part 300 is turned off during the previous frame and the first state signal (D-low) and the second state signal (D-low) are in the low state (0), the first control signal $CS_1$ outputted from the switching part 640 is in the low state (0) that is substantially same as the second control signal $CS_2$. Therefore, the light generating part 300 maintains the off state of the previous frame during the present frame, when the second voltage $V_2$ outputted from the read-out part 500 is higher than the first and second reference voltages $VREF_1$ and $VREF_2$.

When the second control signal $CS_2$ is in the low state (0) and the first state signal (D-low) is in the low state (0) and the second state signal (D-high) is in the high state (1), the first control signal $CS_1$ outputted from the switching part 640 is in the low state (0) that is substantially same as the second control signal $CS_2$. Therefore, the light generating part 300 maintains the off state of the previous frame during the present frame, when the second voltage $V_2$ is higher than the first reference voltage $VREF_1$ and lower than the second reference voltage $VREF_2$.

When the second control signal $CS_2$ is in the low state (0), and the first state signal (D-low) and the second state signal (D-high) are in the high state (1), the first control signal $CS_1$ outputted from the switching part 640 is in the high state (1) that is opposite to the second control signal $CS_2$. Therefore, the light generating part 300 is turned on during the present frame, when the second voltage $V_2$ is higher than the first and second reference voltages $VREF_1$ and $VREF_2$.

When the second control signal $CS_2$, that is, the light generating part 300 is turned on during the previous frame, and the first state signal (D-low) and the second state signal (D-high) are in the low state (0), the first control signal $CS_1$ outputted from the switching part 640 is in the low state (0) that is opposite to the second control signal $CS_2$. Therefore, the light generating part 300 is turned off during the present frame.

When the second control signal $CS_2$ is in the high state (1), and the first state signal (D-low) is in the low state (0) and the second state signal (D-high) is in the high state (1), the first control signal $CS_1$ outputted from the switching part 640 is in the high state (1) that is substantially the same as the second control signal $CS_2$. Therefore, the light generating part 300 maintains the on-state of previous frame during the present frame.

When the second control signal $CS_2$ is in the high state (1) and the first state signal (D-low) and the second state signal (D-high) are in the high state (1), the first control signal $CS_1$ outputted from the switching part 640 is in the high state (1) that is substantially same as the second control signal $CS_2$. Therefore, the light generating part 300 maintains the on-state of the previous frame during the present frame.

When the first state signal (D-low) is in the high state (1), the second state (D-high) may not be in the low state (0).

Figure 9:
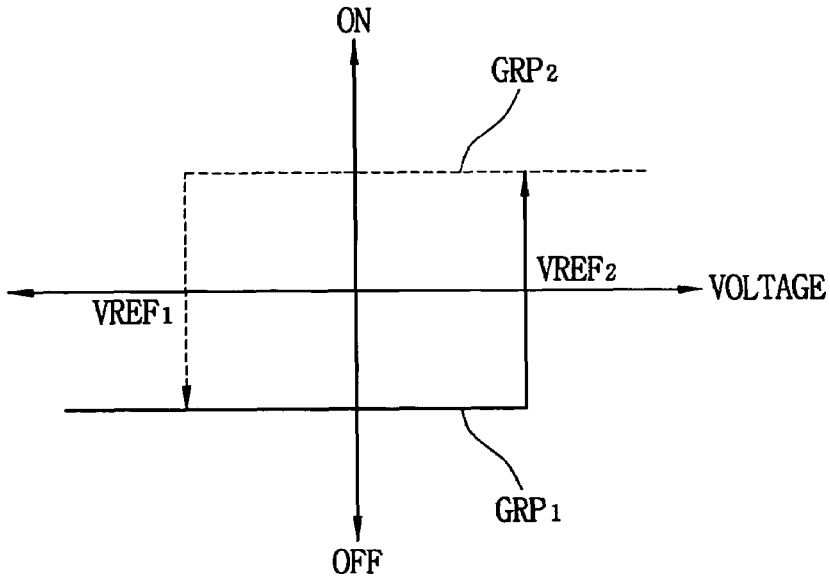
FIG. 9 is a timing diagram showing an output signal of a second driving part according to an exemplary embodiment of the present invention.

FIG. 9 is a timing diagram showing an output signal of a second driving part according to an exemplary embodiment of the present invention. A horizontal axis represents a voltage and the on/off state of the light generating part 300.

Referring to FIG. 9, the first graph $GRP_1$ shows an operation of the light generating part 300 during a present frame in case that the light generating part 300 is turned off during a previous frame.

Referring to the first graph $GRP_1$ in the FIG. 9, the light generating part 300 is turned off during the present frame, when the light generating part 300 is turned off during the previous frame and the second voltage $V_2$ is lower than the second reference voltage $VREF_2$ during the present frame. In addition, the light generating part 300 is turned on, when the light generating part 300 is turned off during the previous frame and the second voltage $V_2$ is higher than the second reference voltage $VREF_2$ during the present frame.

Referring to FIG. 9, the second graph $GRP_2$ shows the operation of the light generating part 300 during the present frame in case that the light generating part 300 is turned on during the previous frame.

Referring to the second graph $GRP_2$ in the FIG. 9, the light generating part 300 is turned on, when the light generating part 300 is turned on during the previous frame and the second voltage $V_2$ is higher than the first reference voltage $VREF_1$ during the present frame. In addition, the light generating part 300 is turned off, when the light generating part 300 is turned off during the previous frame and the second voltage $V_2$ is lower than the second reference voltage $VREF_1$ during the present frame.

According to the present invention, the second driving part receives the second voltage corresponding to the externally provided light, and compares the second voltage with the first and second reference voltages that determine the reference voltage range to output the first control signal that operates the light generating part.

Therefore, the light generating part is turned on/off based on the amount of the externally provided light so as to reduce the power consumption of the display apparatus.

The second driving part also compares the second voltage with the reference voltages to output the first control signal based on the on/off state of the light generating part during the previous frame.

Furthermore, the number of the turning on/off is decreased to stabilize the operation of the light generating part by using the reference voltage range defined by the first and second reference voltages, although the amount of the externally provided light may be close to a predetermined reference amount, thereby increasing a lifetime of the light generating part.

This invention has been described with reference to the exemplary embodiments. It is evident, however, that many alternative modifications and variations will be apparent to those having skill in the art in light of the foregoing description. Accordingly, the present invention embraces all such alternative modifications and variations as fall within the spirit and scope of the appended claims.

What is claimed is:

1. A display apparatus comprising:

a light generating part generating a first light based on a first control signal;

a first driving part outputting a panel driving signal;

a display panel disposed on the light generating part to receive the first light that is generated from the light generating part and to receive a second light that is provided from an exterior to display an image based on the panel driving signal;

a sensing part disposed on the display panel to output a sensing signal based on the second light to the display panel; and a second driving part disposed between the sensing part and the light generating part to compare a reference voltage range with the sensing signal to output the first control signal to cause the light generating part to generate light, the reference voltage range being determined based on a first reference voltage and a second reference voltage higher than the first reference voltage, the first control signal being in substantially same state or opposite state with respect to a second control signal corresponding to an on/off state of the light generating part.

2. The display apparatus of claim 1, wherein the second driving part comprises:

a first comparator comparing the sensing signal with the first reference level to output a first state signal;

a second comparator comparing the sensing signal with the second reference level to output a second state signal; and a switching part applying the first control signal to the light generating part based on the first and second state signals.

3. The display apparatus of claim 2, wherein the second driving part stores the second control signal corresponding to the on/off state of the light generating part, and further comprises a memory part storing the first control signal outputted from the switching part that receives the second control signal.

4. The display apparatus of claim 2, wherein the first state signal is in a low state in case that the sensing signal is higher than the first reference level, the first state signal is in a high state in case that the sensing signal is lower than the first reference level, the second state signal is in the low state in case that the sensing signal is higher than the second reference level, and the second state signal is in the high state in case that the sensing signal is lower than the second reference level.

5. The display apparatus of claim 4, wherein the switching part outputs the first control signal that is substantially same as the second control signal, when the light generating part is turned off and the first and second state signals are in the low state.

6. The display apparatus of claim 4, wherein the switching part outputs the first control signal that is opposite to the second control signal, when the light generating part is turned off and the first and second state signals are in the high state.

7. The display apparatus of claim 4, wherein the switching part outputs the first control signal that is substantially same as the second control signal, when the light generating part is turned off and the first and second state signals are in the low state and the high state, respectively.

8. The display apparatus of claim 4, wherein the switching part outputs the first control signal that is opposite to the second control signal, when the light generating part is turned on and the first and second state signals are in the low state.

9. The display apparatus of claim 4, wherein the switching part outputs the first control signal that is substantially same as the second control signal, when the light generating part is turned on and the first and second state signals are in the high state.

10. The display apparatus of claim 4, wherein the switching part outputs the first control signal that is substantially same as the second control signal, when the light generating part is turned on and the first and second state signals are in the low state and the high state, respectively.

11. The display apparatus of claim 1, wherein the display panel comprises a display area and a peripheral area that is disposed at a position adjacent to the display area, and a plurality of gate lines, a plurality of data lines and the sensing part are disposed in the display area to display an image.

12. The display apparatus of claim 11, wherein a center of the display area corresponds a center of the display panel.

13. The display apparatus of claim 11, wherein a pixel transistor is disposed in the display area, and the pixel transistor comprises a first gate electrode electrically connected to one of the gate lines, a first source electrode electrically connected to one of the data lines and a first drain electrode electrically connected to a pixel electrode.

14. The display apparatus of claim 11, wherein the sensing part comprises a sensing transistor outputting the sensing signal based on the second light, and a first storage capacitor receiving a first voltage based on the sensing signal.

15. The display apparatus of claim 14, wherein the sensing transistor comprises amorphous silicon.

16. The display apparatus of claim 14, wherein the first driving part comprises a plurality of stages electrically connected to one another and a gate driving integrated circuit outputting gate signals to the gate lines based on a first driving voltage, a second driving voltage and a start signal.

17. The display apparatus of claim 16, wherein the sensing transistor comprises a second drain electrode receiving the first driving voltage, a second gate electrode receiving the second driving voltage and a second source electrode outputting the sensing signal, and the first storage capacitor comprises a first electrode receiving the second driving voltage and a second electrode receiving the sensing signal.

18. The display apparatus of claim 16, further comprising a read-out part that reads the first voltage charged in the first storage capacitor.

19. The display apparatus of claim 18, wherein the read-out part further comprises: a read-out transistor outputting a second voltage based on the first voltage and an output signal of a last stage of the stages; and a second storage capacitor that receives the second voltage outputted from the switching transistor.

20. The display apparatus of claim 19, wherein the read-out transistor comprises a third drain electrode receiving the first voltage, a third gate electrode receiving the output signal of the last stage of the stages and a third source electrode outputting the second voltage, and the second storage capacitor comprises a third electrode receiving the second driving voltage and a fourth electrode receiving the second voltage.

21. The display apparatus of claim 16, wherein the gate driving integrated circuit is disposed in the peripheral area.

22. The display apparatus of claim 21, wherein the gate driving integrated circuit comprises amorphous silicon.

23. The display apparatus of claim 16, wherein the first driving part comprises one chip having the gate driving integrated circuit and a data diving integrated circuit outputting data signals to the data lines.

24. The display apparatus of claim 16, further comprising a reset part that initializes the sensing part at every predetermined interval.

25. The display apparatus of claim 24, wherein the reset part comprises a fourth gate electrode receiving the start signal, a fourth drain electrode receiving the first voltage and a fourth source electrode receiving the second driving voltage.

26. A method of driving a display apparatus comprising:

generating a first light based on a control signal;

outputting a panel driving signal;

receiving the first light and a second light that is provided from an exterior to display an image based on the panel driving signal;

outputting a sensing signal based on the second light; and comparing in a first comparator the sensing signal with a first reference level and producing a first state signal and comparing in a second comparator a second reference level higher than the first reference level and producing a second state signal, the first and second reference levels determining a voltage reference range, and switching between the first and second state signals to output the control signal.

27. The method of claim 26, wherein the image is displayed by using the first light during a present frame, when the image is displayed by using the first light during a previous frame and the sensing signal is lower than the second reference level.

28. The method of claim 26, wherein the image is displayed by using the second light during a present frame, when the image is displayed by using the first light during a previous frame and the sensing signal is higher than the second reference level.

29. The method of claim 26, wherein the image is displayed by using the first light during a present frame, when the image is displayed by using the second light during a previous frame and the sensing signal is lower than the first reference level.

30. The method of claim 26, wherein the image is displayed by using the second light during a present frame, when the image is displayed by using the second light during a previous frame and the sensing signal is higher than the first reference level.

* * * * *